United States Patent [19]

Bleimann

[11] Patent Number: 4,633,480

[45] Date of Patent: Dec. 30, 1986

[54] LIQUID COOLED COVER FOR ELECTRIC ARC FURNACE

[75] Inventor: Karl R. Bleimann, Matthews, N.C.

[73] Assignee: Fuchs Systems, Inc., Salisbury, N.C.

[21] Appl. No.: 641,524

[22] Filed: Aug. 16, 1984

[51] Int. Cl.[4] ..... F27D 1/12

[52] U.S. Cl. ..... 373/74

[58] Field of Search ..... 373/74, 73; 266/241; 432/238

[56] References Cited

U.S. PATENT DOCUMENTS 3,429,973 2/1969 Carter et al. ..... 373/74

4,273,949 6/1981 Fischer et al. ..... 373/74

*Primary Examiner*—Roy N. Envall, Jr.

*Attorney, Agent, or Firm*—Ralph H. Dougherty; James B. Hinson

[57] ABSTRACT

A water cooled roof for an electric arc furnace made up of a multiplicity of water cooled panels surrounded by a water distribution and collection ring, each portion of the roof being insulated from each other portion, including the roof panel, support arms and the roof rack. The invention provides a means for interrupting the flow of an inductive current around each electrode by creating a gap in the metal surrounding each electrode, thus insulating the furnace roof or cover from each phase of the three phase current.

11 Claims, 8 Drawing Figures

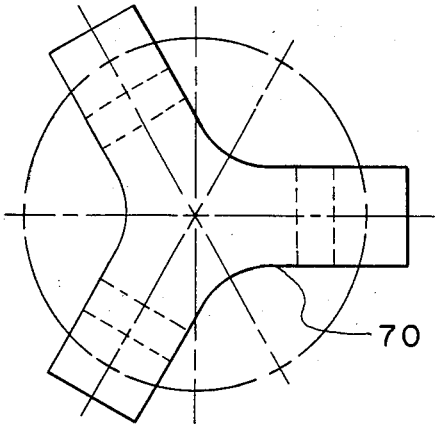
Fig. 3
Fig. 4
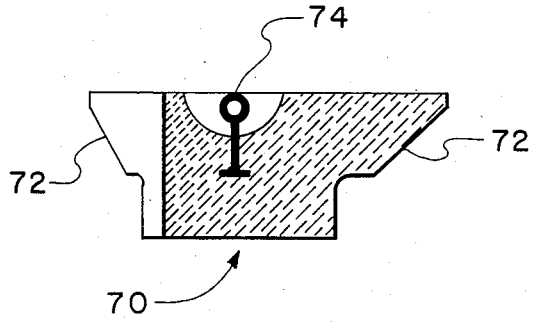
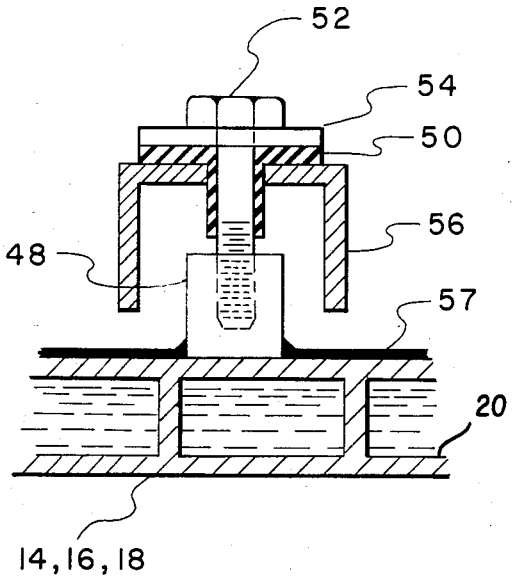
Fig. 5

LIQUID COOLED COVER FOR ELECTRIC ARC FURNACE

BACKGROUND OF THE INVENTION

This invention relates to an electric arc furnace roof cover having provision for liquid cooling therein and further having means for dramatically reducing eddy currents in the portion of the cover adjacent the arc furnace electrodes which protrude therethrough.

Liquid cooled roofs or covers for electric arc furnaces are known from U.S. Pat. Nos. 1,922,312; 4,197,422; 4,273,949; 4,443,880; and others. Each of these patents teaches a construction which promotes eddy currents within the roof.

Water cooled electric furnace roofs or covers are known from Buhler et al U.S. Pat. No. 4,443,880, which teaches a unitary furnace cover, having parallel cooling pipes generally vertical to the furnace tipping direction and having a specified spacing between the cooling pipes. Mannsfield U.S. Pat. No. 1,922,312 teaches a cover having a plurality of sections 21 separated from each other by insulating walls 23. Mannsfield recognizes that there are induction losses in the cover, and utilizes a non-magnetic portion 31 in an attempt to reduce such losses.

It has long been desired to provide a liquid cooled furnace roof for electric furnaces which is compatible with liquid cooled furnace wall panels. It is particularly desirable to utilize a cooled furnace cover which includes provision for electrical and thermal insulation on its underside.

In the situation in which three electrodes protrude through a single hole in a roof, if two electrodes should happen to touch the side of the hole at the same time they will create an arc, current will flow between them, and the arcing will damage the panel, usually by creating one or more holes in the panel, resulting in the loss of all of the cooling fluid (water) through such hole. Water is dangerous in a furnace, and its presence can lead to an explosion.

In the case where a roof has three holes in it, an electrode positioned in each hole, the current passing downwardly through the electrode sets up an induction current around the hole, because the metal around each electrode is completely conductive, being completely connected to itself all the way around the electrode. Providing three separate tunnels as a portion of the roof without a complete ring of metal around any one electrode, breaks up the tendency to develop induction current in the roof panels.

The passing of induction current through the roof around the electrodes can lead to arcing, to over heating of the metal in the panel, and ultimately to loss or drain of energy. The tendency for induction currents to be set up increases by the size of the transformer. Small, low power furnaces have a lesser tendency to create induction currents.

The present invention avoids the creation of induction currents in the roof by electrically separating the potential from all three electrodes.

SUMMARY OF THE INVENTION

The present invention is a water cooled roof for an electric arc furnace made up of a multiplicity of water cooled panels surrounded by a water distribution and collection ring, each portion of the roof being insulated from each other portion, including the roof panel, support arms and the roof rack. The invention provides a means for interrupting the flow of an inductive current around each electrode by creating a gap in the metal surrounding each electrode, thus insulating the furnace roof or cover from each phase of the three phase current.

OBJECTS OF THE INVENTION

It is the principal object of this invention to provide a liquid cooled furnace cover for electric arc furnaces which has a long useful life.

It is another object of this invention to provide a water cooled electric arc furnace roof or cover which promotes efficient heat transfer into the molten metal bath.

It is also an object of this invention to provide a water cooled cover for an electric arc furnace, the underside of which is provided with a renewable electrical and thermal insulating surface.

It is also an object of this invention to provide a water cooled roof for an electric arc furnace which will reduce dramatically eddy current flow around the electrodes when in the operating position.

BRIEF DESCRIPTION OF THE DRAWINGS

FIG. 3 is a top view of a Y brick for placement at the center of the roof.

FIG. 4 is a cross section of the Y brick of FIG. 3 taken along the lines 4—4 of FIG. 3.

FIG. 5 is an elevational section view of a portion of FIG. 2 on a larger scale showing the connection of the roof to its support and the insulation arrangement.

DETAILED DESCRIPTION

Figure 1:
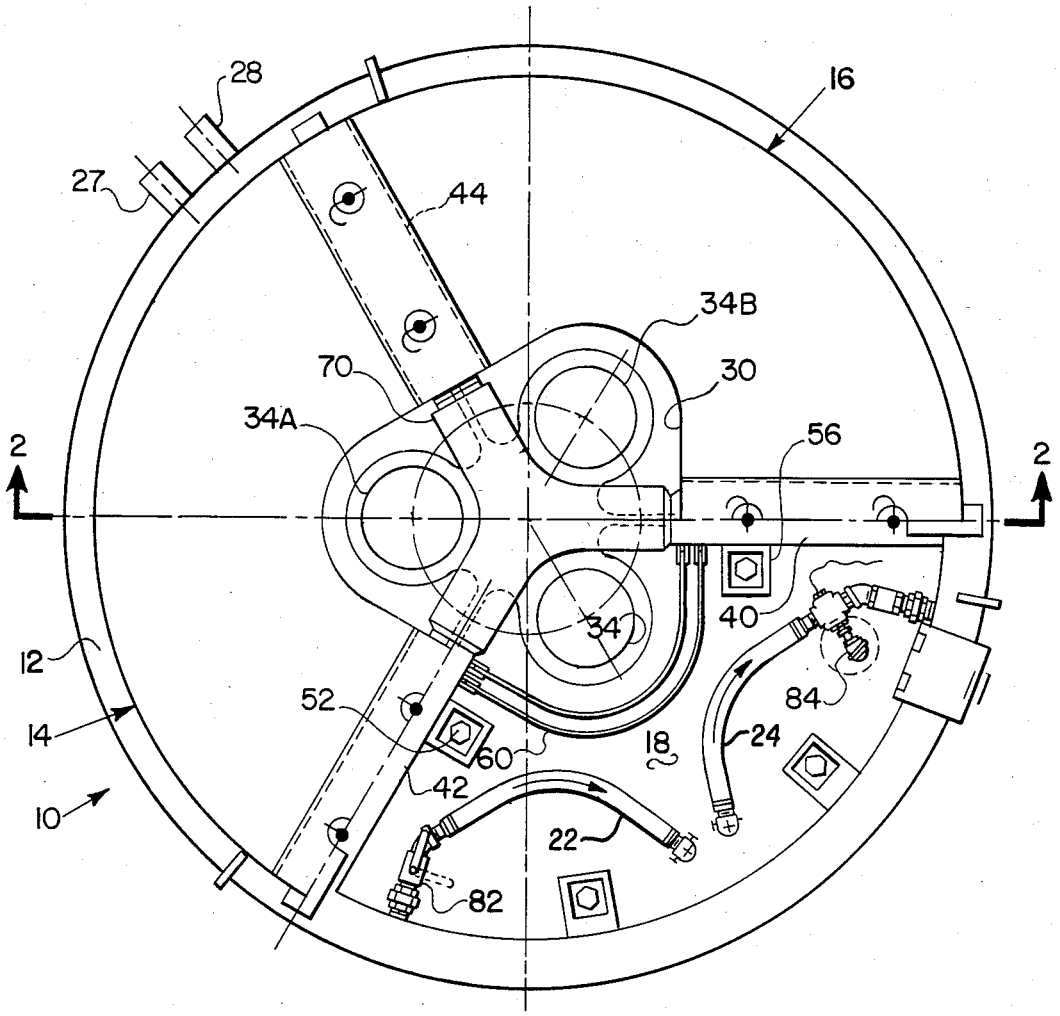
FIG. 1 is a top view of the invented liquid-cooled cover for an electric arc furnace having a portion of the dust cover removed for clarity.

Refering now to the drawings, a liquid cooled furnace cover 10 has a peripheral liquid distributing conduit, or ring, 12 surrounding it. Three insulated cover panels 14, 16, and 18 containing water cooling channels or pipes 20 are situated within the ring 12 and are electrically insulated from each other part of the roof. The cooling water distribution ring 12 is connected to the interior water conducting channels 20 of each cover panel by a conduit 22 and appropriate connections. Heated water is removed from the panel through cooling water removal conduit 24 to a cooling water removal channel 26 in water distribution ring 12. The ring 12 may have two or more conduits through its cross section to promote better cooling.

Water is provided to distribution ring 12 through inlet 27 and is removed from the distribution ring through outlet 28.

An opening 30 is provided at the center of the roof to receive three electrodes 34A, 34B, 34C. The electrodes are mounted or supported by electrode arms, not shown, above the furnace roof, and protrude downwardly therethrough into a bath of molten metal within the furnace.

Figure 2:
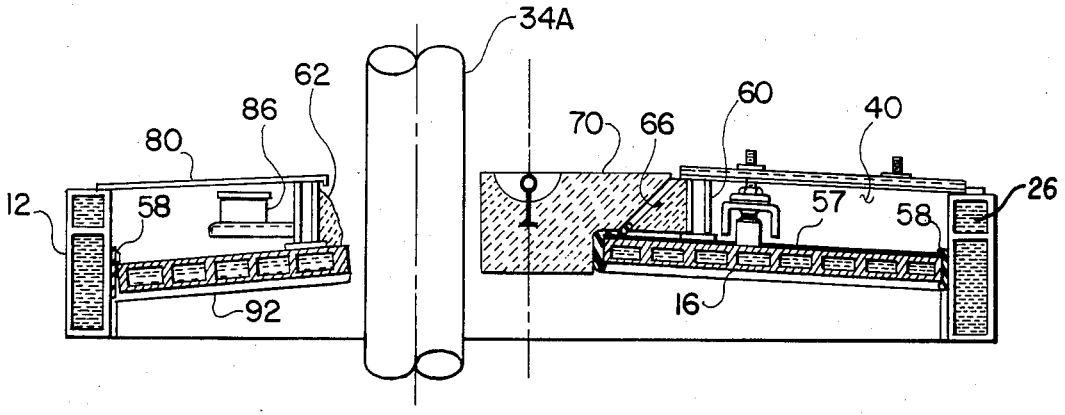
FIG. 2 is a sectional elevation view taken along the line 2—2 of FIG. 1.

Cantilevered beams 40, 42, 44 support the roof panels. As best shown in FIG. 5, each cantilevered beam has a channel or other similar support arm 56 fixed thereto for support of the cover panel. A high temperature resistant, electrically resistant insulation, such as pressed silicon fiber or other ceramic bushing 50 is seated in the arm 56 and a bolt 52 protrudes through a lock washer 54 and through the bushing into a nut 48. The panel anchor bolts are isolated electrically from the support arm and from the other panels by the solid layers of high temperature reistant, electrically resistant insulation. The bolt thread is connected to the panel by a collar 48 which is welded to the panel and acts as a nut. Note that insulation such as Micarta is effective for temperatures into the range of 1200° to 1500° F. Insulating block 58 insulates the water cooled panel from the ring 12. A double wall 60 defines the vertical wall of a central recess, the bottom of which is formed by the top of the panels 14, 16, 18, a portion of each panel protruding into the central opening part way around the nearest electrode. A refractory composition such as a gunning mix 62 can be placed in this region as shown in FIG. 2. A tapered refractory seat 66 is provided in the same region between the electrodes to accomodate a Y style refractory block 70 shown in FIGS. 3 and 4. This block has a mating tapered seat 72 and may be provided with an integral lifting ring 74, if desired.

Dust covers 80 are provided atop the panels to protect the interior of the panels from dirt and foreign matter. Such dust covers may be provided with doors, not shown, for access to valves 82, temperature measuring devices 84, and junction box 86.

The present invention is characterized by all flexible feed and return hoses, valves, temperature measuring devices, bleed valves, grounding cables, lifting lugs, and anchoring devices for each panel being located in the recess between adjacent radial cantilevered beams and covered by the dust covers.

Figure 8:
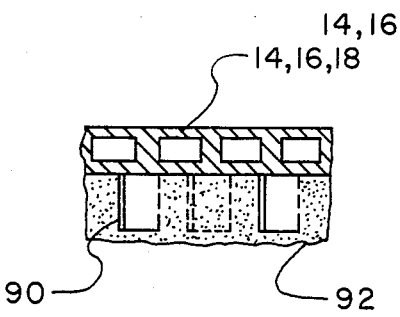
FIG. 8 is a sectional view of the portion of the panel of FIG. 7 taken along the line 8—8 of FIG. 7.
Figure 7:
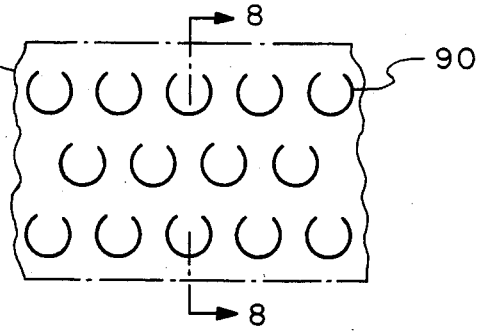
FIG. 7 is a partial bottom view of a portion of a water cooled panel for use in the invented furnace cover showing refractory anchors.

The water cooled panels are preferably made of steel or copper plate, with vertical plates fixed into position as shown to form cooling water passageways. The underside of the sectional roof panels 14, 16, 18 can be provided with anchor cups or lugs 90, shown in FIGS. 7 and 8, for retaining a layer of refractory 92 such as gunning mix, or for promoting the build up of slag splash or spatter to generate a renewable electrical and thermal insulating surface on the bottom of the panel. Suitable refractory retaining cups are disclosed in U.S. Pat. No. 4,259,539, wherein they are employed to retain slag on water cooled furnace walls. They are also effective when utilized on the bottom of a water cooled roof.

Alternatively, the water cooled panels can be made from steel or copper pipes. In such case, refractory can be sprayed directly on the bottom of the panel. The generally rough or corrugated surface of the pipes in the panel will promote the adherence of slag splash and spatter, and the panel need not have such refractory retaining cups.

Figure 6:
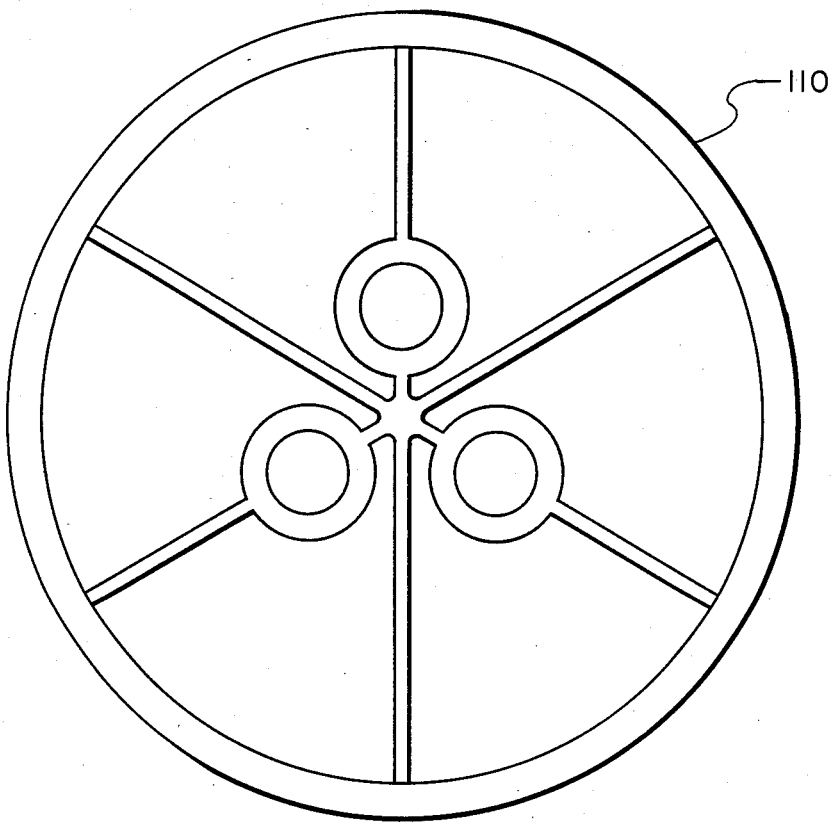
FIG. 6 is a top view of an alternative embodiment of the invented cover having six sections each electrically insulated from each other.

The alternative embodiment shown in FIG. 6 depicts a roof 110 having six separate sections or panels, each of which is supported by radial arms and is insulated therefrom. Each pair of panels forms a mirror image. The center of the furnace cover is easily covered by a small refractory plate or brick to reduce the loss of heat and gases through that opening. This roof is particularly advantageous for use in large capacity furnaces.

Each phase is separately insulated, and the water cooled panels are each separated by insulation. The insulation is preferably Micarta and silicon cloth, which is temperature resistant to 3200° C. Each panel is insulated against the main roof structure and against each other. Each phase creates a potential by itself. In the present invention, there is not current flowing and no voltage flowing between any two phases. Thus, the heat is transferred into the bath rather than between the components of the furnace and roof.

The current flows through the electrodes and the bath, but if an electrode touches a panel, because of looseness in the electrode support arm, at the same time a second electrode touches a panel, since the panels are insulated from each other, arcing will not occur.

In the invented furnace roof, the induction field created around each phase, i.e., around each individual electrode, is interrupted by a lack of metal panel completely surrounding the electrode. The water-cooled panel is slotted so no current can flow completely around it. This dramatically reduces current flow around the electrodes.

Standard electric furnace roofs require a certain amount of brick. The only brick utilized in the invented cover is a top center refractory block, which is a "Y" block that fits into a mating recess in the central opening in the cover.

Since there is no portion of any panel between the electrodes, the panel does not form a continuous loop around any electrode, which minimizes the amount of eddy current picked up. Each panel is isolated electrically from the adjacent panel by pressed silicon fiber insulating sheets between the steel supporting members in the panel. Above the steel panel and beneath the insulating sheet is a compressable, compactable layer of fiberglass or high temperature insulating glass such as Fibrefrax. This protects the insulating sheet from slag and steel splash and splatter which might otherwise penetrate between the vertical edges of adjacent panels and begin the destruction process.

SUMMARY OF THE ACHIEVEMENT OF THE OBJECTS OF THE INVENTION

From the foregoing it is readily seen that I have provided a liquid cooled furnace cover for electric arc furnaces which has a long useful life, a water cooled electric arc furnace roof or cover which promotes efficient heat transfer into the molten metal bath, the underside of which roof is provided with a renewable electrical and thermal insulating surface, and which will reduce dramatically any current flow around the electrodes when in the operating position.

It is also apparent from the foregoing that other alternative embodiments of the invention are possible. Thus, while in accordance with the patent statutes, both prefered and alternative embodiments of the invention have been illustrated and described in detail, it is to be particularly understood that the invention is not limited thereto or thereby, but only by the scope of the following claims.

What is claimed is:

1. A water-cooled cover for an electric arc furnace, comprising:

a. a peripheral tubular member adapted for water flow therethrough;

b. a plurality of equally spaced cantilevered beam supports fixed to said peripheral member, extending inwardly and inclined upwardly from said peripheral member;

c. an equal number of water-cooled panels suspended from and between, and insulated from said cantilevered support beams and from each other by high temperature resistant, electrically resistant insulation;

d. means connected to a water source and to said peripheral ring for introducing and removing cooling water to and from said peripheral ring;

e. water conduit means connecting said peripheral ring and each of said water-cooled panels;

f. each of said water-cooled panels being adapted to surround no more than one electrode no more than about 300°.

2. A water-cooled cover according to claim 1, further comprising an upstanding vertical wall atop each of said water cooled panels between remote from the peripheral member and defining a refractory retaining ledge, or said panel and a refractory composition on said ledge.

3. A water-cooled cover according to claim 2, wherein said refractory composition forms a tapered refractory seat.

4. A water-cooled cover according to claim 2, further comprising a refractory block of a generally "Y" configuration seated in said refractory seat.

5. A water-cooled cover according to claim 4 wherein said refractory block has a central eye therein to facilitate handling, installation, and removal thereof.

6. A water-cooled cover according to claim 4 wherein said refractory block has a recess centered in the top thereof, and said central eye is fixed in said recess.

7. A water-cooled cover according to claim 1 wherein said insulation comprises a first layer of pressed silicon fiber and a second layer of ceramic fiber.

8. A water-cooled cover according to claim 1 having three panels suspended from three cantilevered beams.

9. A water-cooled cover according to claim 1 having six panels suspended from six cantilevered beams.

10. A water-cooled cover according to claim 1 wherein refractory anchors are affixed to the underside of said panels.

11. A water-cooled cover according to claim 1 wherein refractory material is fixed to the underside of said panels prior to placing the cover in operation.

* * * * *